US007018329B2

(12) United States Patent
Yu

(10) Patent No.: US 7,018,329 B2
(45) Date of Patent: Mar. 28, 2006

(54) SEX AID DEVICE

(76) Inventor: Che-ming Yu, 1 Fl., No. 5, Alley 17, Lane 81, Sec. 6, Minchiuan E. Rd., Taipei (TW) 114

( * ) Notice: Subject to any disclaimer, the term of this patent is extended or adjusted under 35 U.S.C. 154(b) by 0 days.

(21) Appl. No.: 10/327,050

(22) Filed: Dec. 24, 2002

(65) Prior Publication Data

US 2004/0122288 A1 Jun. 24, 2004

(30) Foreign Application Priority Data

Sep. 25, 2002 (TW) ..... 91121940 A

(51) Int. Cl.
*A61F 5/00* (2006.01)

(52) U.S. Cl. ..... 600/38; 128/845

(58) Field of Classification Search ..... 600/38; 128/845; 297/273, 311, 312, 344.21, 16.1, 297/195.1, 445.1
See application file for complete search history.

(56) References Cited

U.S. PATENT DOCUMENTS

| | | | | |
|---|---|---|---|---|
| 3,971,592 | A * | 7/1976 | Farley | 297/448.2 |
| 4,518,198 | A * | 5/1985 | Daniels | 297/229 |
| 5,294,176 | A * | 3/1994 | Asinovsky | 297/245 |
| 5,507,563 | A * | 4/1996 | Arthur, Jr. | 297/440.23 |
| 6,030,039 | A * | 2/2000 | Essler | 297/273 |
| 6,199,552 | B1 * | 3/2001 | Crespo | 128/845 |
| 6,640,808 | B1 * | 11/2003 | Fessler | 128/845 |
| 6,691,709 | B1 * | 2/2004 | Cynn | 128/845 |
| 6,698,431 | B1 * | 3/2004 | Harris et al. | 128/845 |

* cited by examiner

*Primary Examiner*—John P. Lacyk
(74) *Attorney, Agent, or Firm*—Bacon & Thomas, PLLC

(57) ABSTRACT

A sex aid device for assisting a human male and female couple to engage in sexual intercourse. The device includes a frame and resilient belts attached to the frame for providing a seat for a female above the male lying beneath the frame. The frame includes a pair of substantially parallel, transverse rods and a pair of substantially U-shaped upright legs, allowing the male to lie down beneath the rods without being hindered by the legs. The resilient belts define and opening to permit access to the seated female's genitals.

16 Claims, 7 Drawing Sheets

SEX AID DEVICE

FIELD OF THE INVENTION

The present invention relates to a sex aid device for assisting a human male and female couple to engage in sexual intercourse.

BACKGROUND OF THE INVENTION

It is believed that sex intercourse, and other types of sexual activity, are among factors for improving close relationship between a human male and female couple. The performance of the sexual act requires the male a certain amount of strength and mobility of the lower part of the trunk. For a man without the necessary degree of strength and mobility, it would be difficult to perform the sexual act.

For those who are handicapped or otherwise physically weak, it would be desirable for them to utilize sex aid devices to compensate their physical deficiencies.

SUMMARY OF THE INVENTION

It is an object of the present invention to assist the handicapped, especially for those who lose limb(s), to engage in sexual intercourse.

It is a further object of the present invention to alleviate the burden of physical strength in sexual activity, particularly, for those who are aged, infirm or corpulent.

According to the present invention, a sex aid device comprises a frame and at least one resilient member mounted on the frame in a fixed or removable manner. The frame has a leg portion and a support portion. The frame allows the male to lie down beneath the support portion without being hindered by the leg portion. The at least one resilient member each has its ends attached to the support portion for providing a seat for the female above the male lying down beneath the support portion. The at least one resilient member also defines at least one opening allowing genitals of the female seated on the at least one resilient member to be accessed by the genitals of the male lying therebeneath.

In use, the female seated on the at least one resilient member may proceed up-and-down or 360-degree rotational movement during the sexual activity while supported by the at least one resilient member, thereby facilitating control of body action or alleviate burden of physical strength. According to the invention, the device can support most of the female's weight so that the male need not to bear the full weight of the female and also assist her to attain desired actions during the sex activity.

The invention, together with the advantages thereof, may best be understood by reference to the following description taken in connection with the accompanying drawings.

DETAILED DESCRIPTION OF THE PREFERRED EMBODIMENTS

Figure 1:
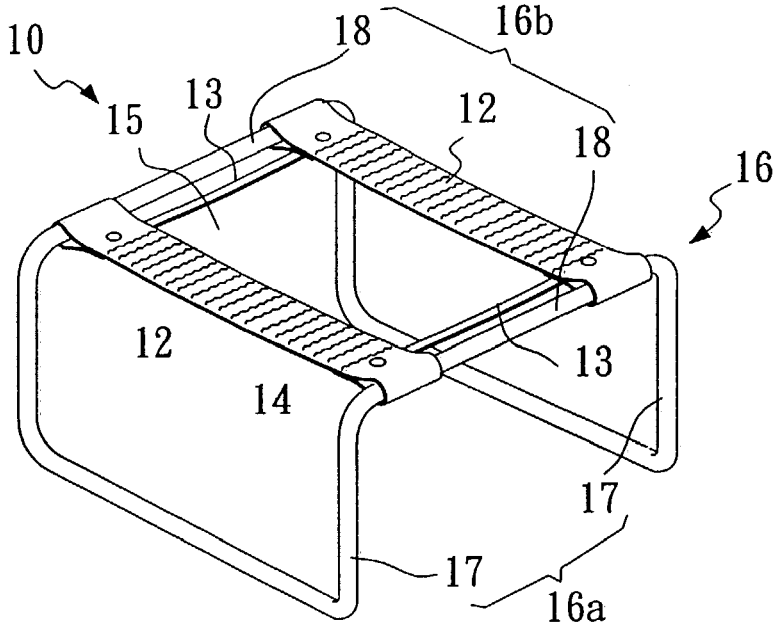
FIG. 1 is a perspective view of a first embodiment of a sex aid device in accordance with the present invention.

Referring to FIG. 1, there is depicted a sex aid device constructed in accordance with the present invention and designated as 10. The sex aid device comprises a one-piece frame 16 and two spaced apart resilient belts 12 attached to the frame 16.

The frame 16 includes a leg portion 16*a* and a support portion 16*b* integrated with the leg portion. The leg portion 16*a* comprises a pair of substantially U-shaped upright legs 17 and the support portion 16*b* comprises a pair of substantially parallel, transverse rods 18 disposed in an exclusively transverse direction relative the leg portion 16*b*. According to the preferred embodiment, the leg portion and the support portion are integrally formed so that the frame 16 is a one-piece element. The frame can be made of iron or steel or synthetic material, as long as such material is capable of supporting the users during vigorous sexual activity.

Each end of the resilient belts 12 is wrapped around the rods 18 and fixed by rivets 14. Alternatively, belts 12 may be attached to the rods by screw and nut arrangement or sewing (not shown). As shown in FIG. 1, the two spaced apart belts 12 are parallel to each other, defining an opening 15 therebetween. Two non-resilient bands 13 are tied to resilient belts 12 to limit relative transverse movement between the belts, so as to prevent the belts from being further displaced away from each other. The resilient belts 12 can be made of any resilient material, e.g. rubber or synthetic material, as long as such material is capable of providing enough resilience and flexibility and sufficient strength to support the users during vigorous sexual activity.

Figure 2:
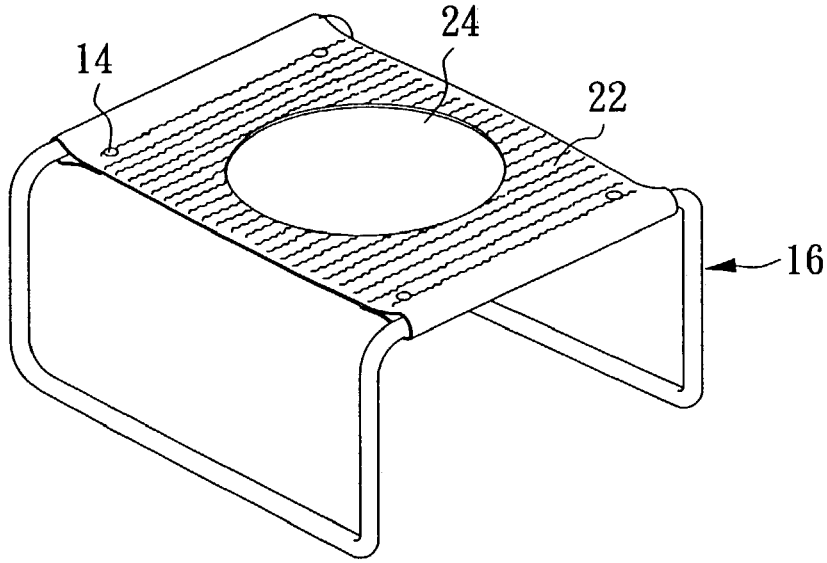
FIG. 2 is a second embodiment of a sex aid device in accordance with the present invention.

FIG. 2 shows an alternative embodiment 20 of a sex aid device according to the invention, which is similar to that of FIG. 1, except that a single piece of resilient cloth 22 with a central opening 24 thereon is attached to the frame 16.

Figure 3:
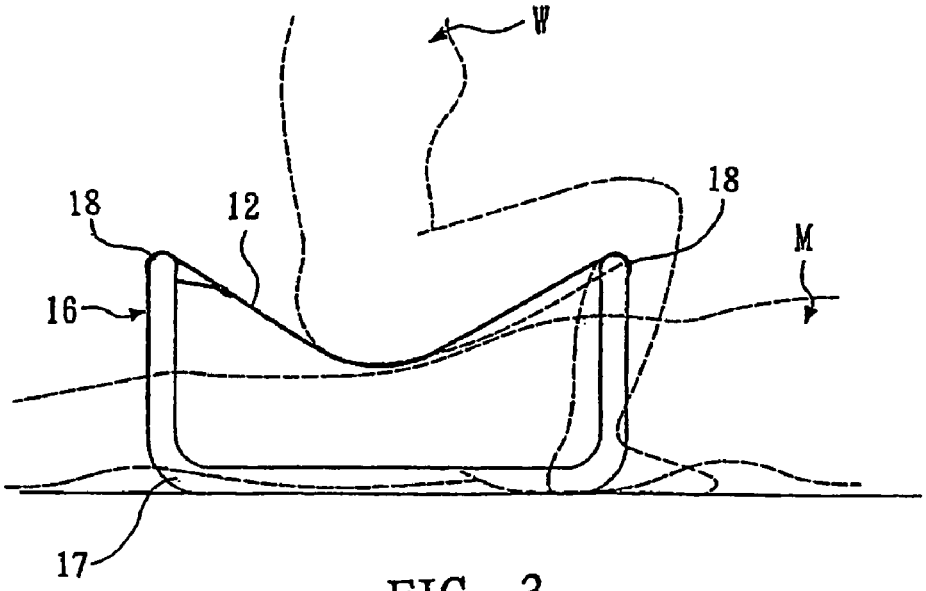
FIGS. 3 and 4 are side view and top view of the sex aid device of FIG. 1 in use, respectively, showing a woman seated on belts of the device and a man lying supine beneath the belts of the device.
Figure 4:
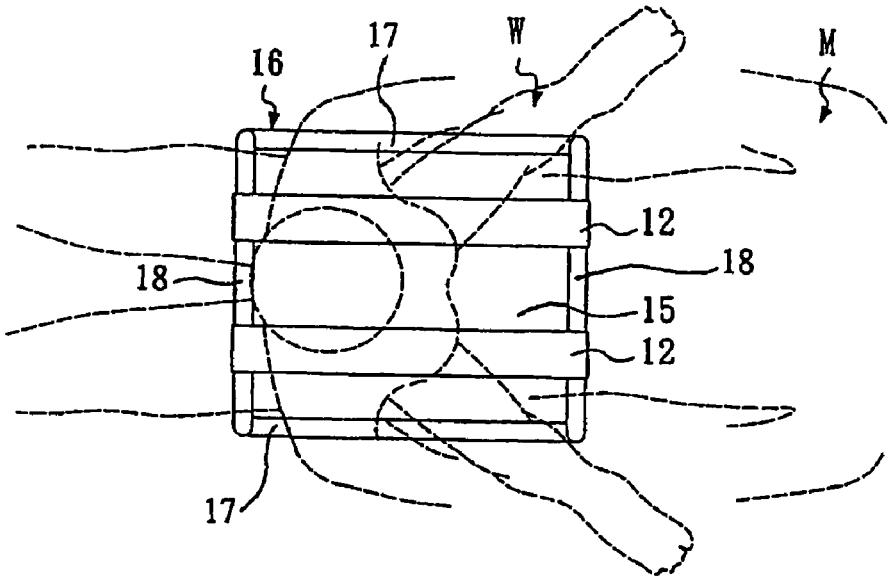

FIGS. 3 & 4 illustrate a method of using the device 10 according to the invention. A person M, preferably a man, lies supine on a surface, such as a bed or the floor. He places the device across the lower portion of his trunk, centered roughly above his sexual organ. A person W, preferably a woman, is seated on the resilient belts 12 with her thighs supported by the belts. Thus, the couple can engage in sexual intercourse in a "female-up and male-down" manner. It should be noted that the resilient belts 12 are adapted to not only sufficiently bear the woman's weight without exerting excessive pressure on the man's trunk, but also keep close sexual intercourse between them during sexual activity. Since the man does not bear any (or just little) weight of the woman, uncomfortable feelings, such as numb legs or pains can be avoided for him. Moreover, due to the resiliency and three-dimensional degrees of freedom of movement of the resilient belts 12, the woman seated thereon thus can move in each direction, e.g. up-and-down, left-and-right, front-and-back and rotation of complete 360 degrees.

In addition, due to the differences in individual user's height and weight, the required motion amplitude of the resilient belts 12 during sexual activity may be different. Therefore, resilient belts of different sizes may be provided so as to allow the users to attain a suitable angle, depth and motion pattern during sexual act.

Figure 5:
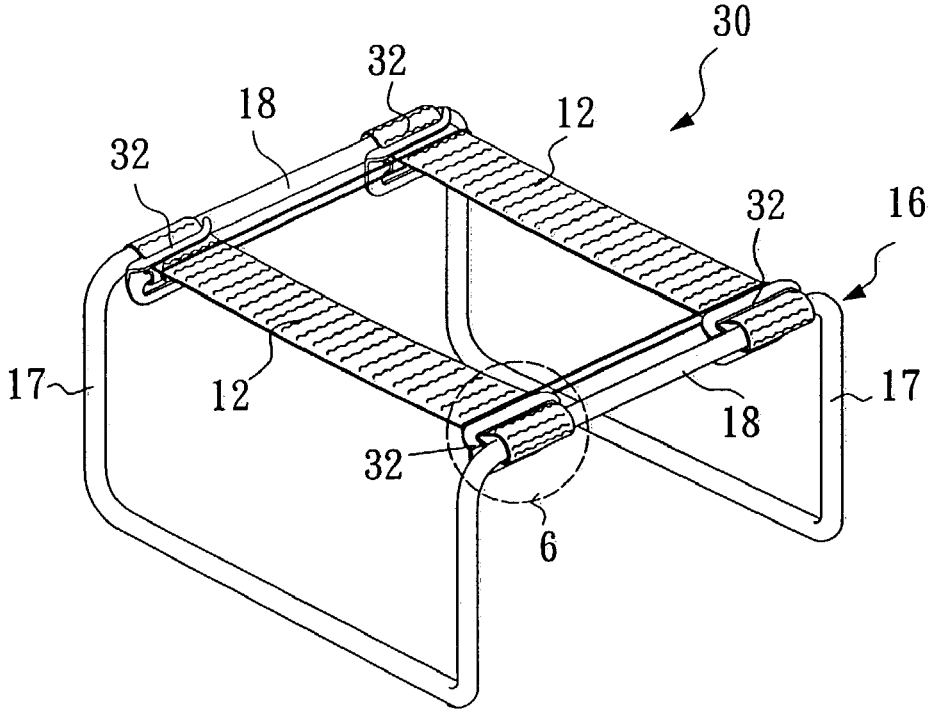
FIG. 5 a perspective view of a third embodiment of a sex aid device in accordance with the present invention.
Figure 7:
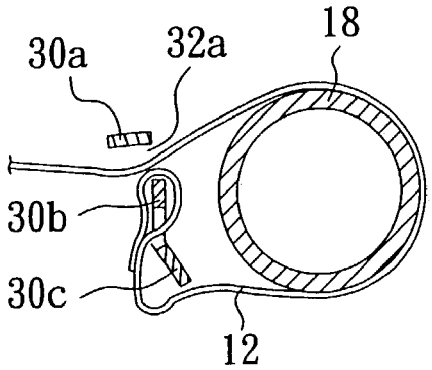
FIG. 7 is a cross-sectional view taken along the line A—A of FIG. 6, illustrating attachment of the resilient belt to the rod.
Figure 6:
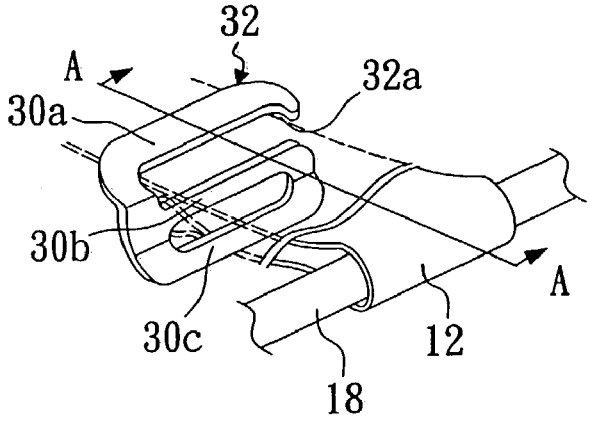
FIG. 6 is an enlarged, fragmented view of the area indicated by the number 6 in FIG. 5, illustrating the attachment of a resilient belt to a rod.

It is possible that a user may wish to replace old resilient belts with new ones or ones of different size. Therefore, a further embodiment of a device according to the invention is shown in FIG. 5, wherein a device 30 comprises an integral frame 16, two resilient belts 12 and two bands 13, as those shown in FIG. 1. However, each resilient belt 12 has its both ends attached to a buckle 32, as shown in FIGS. 6 and 7, which is conventionally known and comprised of portions 30*a*, 30*b* and 30*c* and an opening 32*a*. The belt 12 may be removably attached to the frame 16 by the users as follows: the belt 12 with its ends having being attached to the portion 30*b* of the buckle 32 in factory has each end wrapped around the rod 18 and then inserted through a gap between the portions 30*a* and 30*b* via the opening 32*a*.

Figure 8:
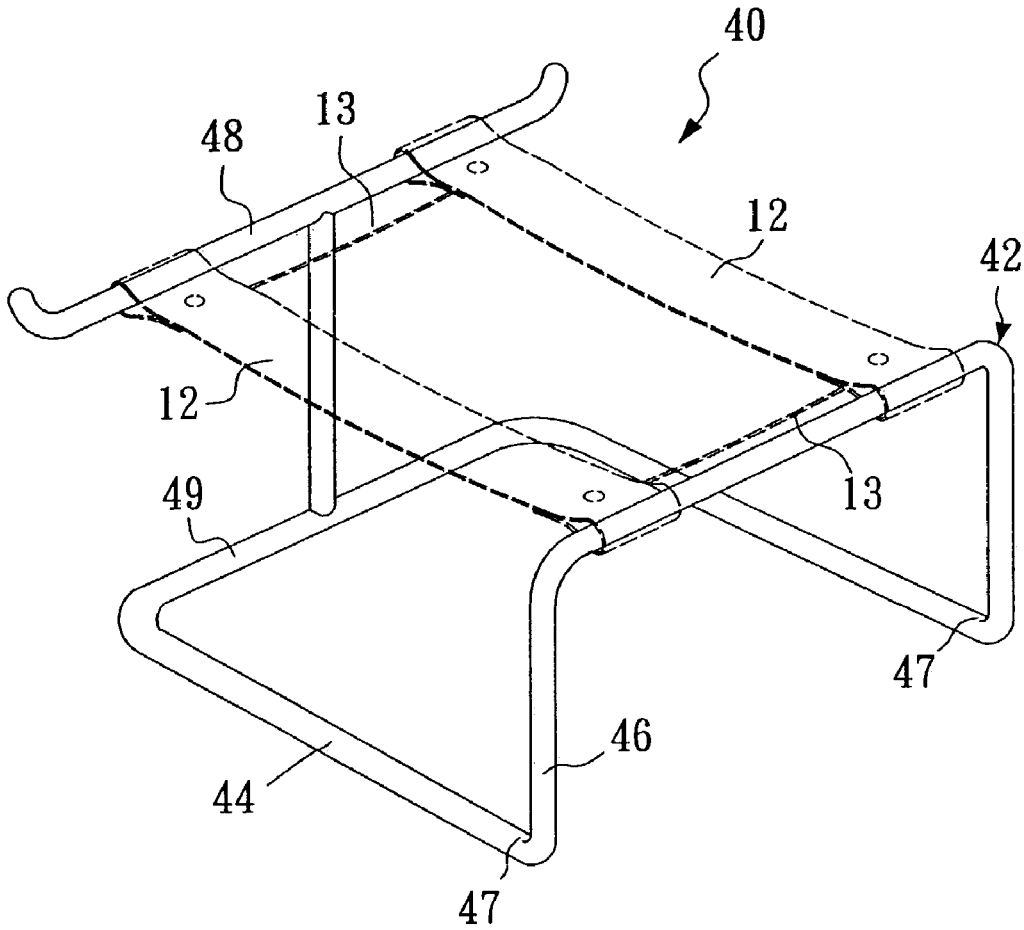
FIG. 8 is a perspective view of a fourth embodiment of a sex aid device in accordance with the present invention.

FIG. 8 illustrates a further embodiment of a sex aid device according to the invention, wherein a device 40 comprises a frame 42 and resilient belts 12. The frame 42 comprises a horizontally disposed U-shaped leg 44 and a support portion. The U-shaped leg 44 has a base 49 and open ends 47. The support portion comprises a substantially T-shaped rod 48 extending upward from the base 49 and an inverted U-shaped rod 46 extending upward from the open ends 47 of the U-shaped leg 44. Resilient belts 12 can be mounted between the T-shaped rod 48 and the inverted U-shaped rod 46. In this case, a person may lie supine beneath the frame with the rod 46 toward his or her head.

Figure 9:
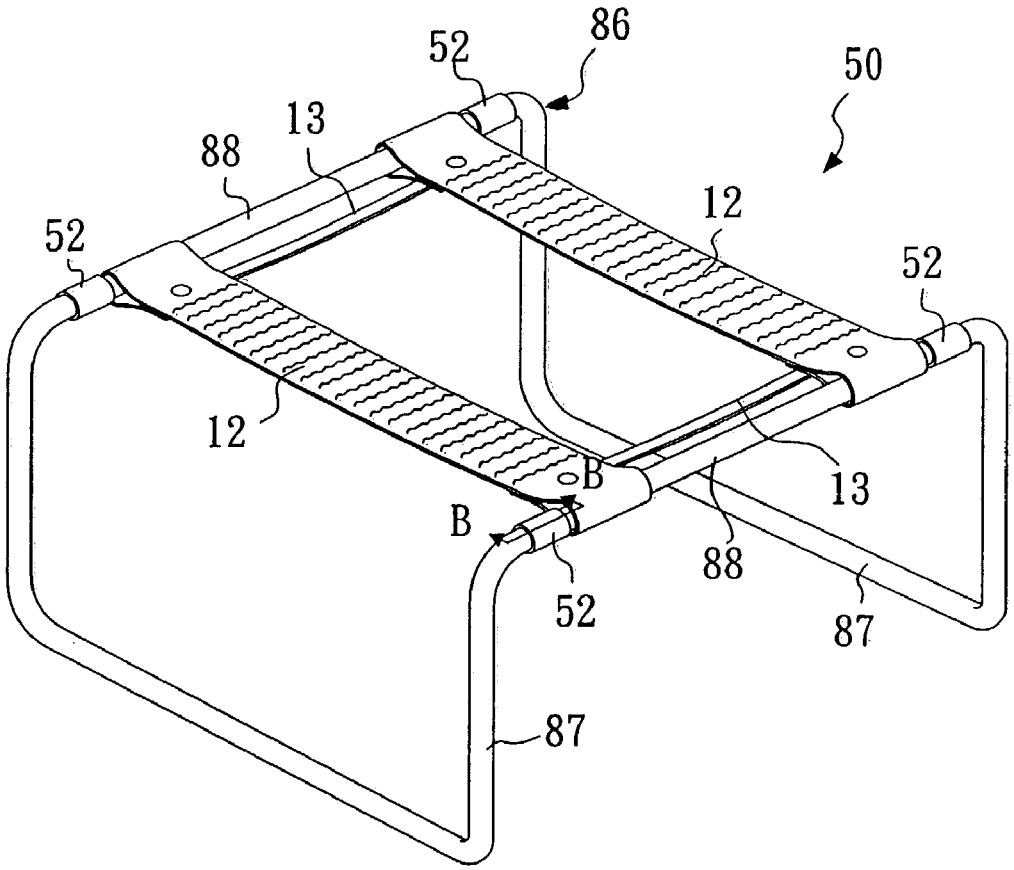
FIG. 9. a perspective view of a fifth embodiment of a sex aid device in accordance with the present invention.
Figure 10:
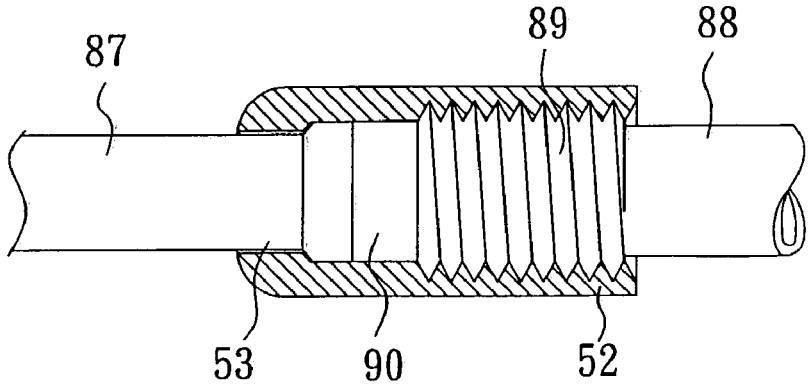
FIG. 10 is an enlarged, fragmented and sectional view taken along the line B—B in FIG. 9, illustrating a coupler connecting a rod to a leg.

FIG. 9 illustrates a further embodiment of a sex aid device according to the invention, wherein a device 50 comprises a detachable frame 86 and resilient belts 12. The frame comprises legs 87 and rods 88 removably connected to the legs 87 through sleeve-like couplers 52. As shown in FIG. 10, each end of the rods 88 has outer threads 89 and the legs 87 each has an enlarged end 90. The coupler 52 has at one end internal threads engageable with the outer threads of the rod 88 and at the other end an opening 53 smaller than the enlarged end 90 and configured to prevent the coupler 52 from separating from the leg 87. Thus, it is advantageous that through the couplers 52, rods 88 and legs 87 can be disconnected for the purpose of replacing old belts 12 or storing the device 50.

Figure 11:
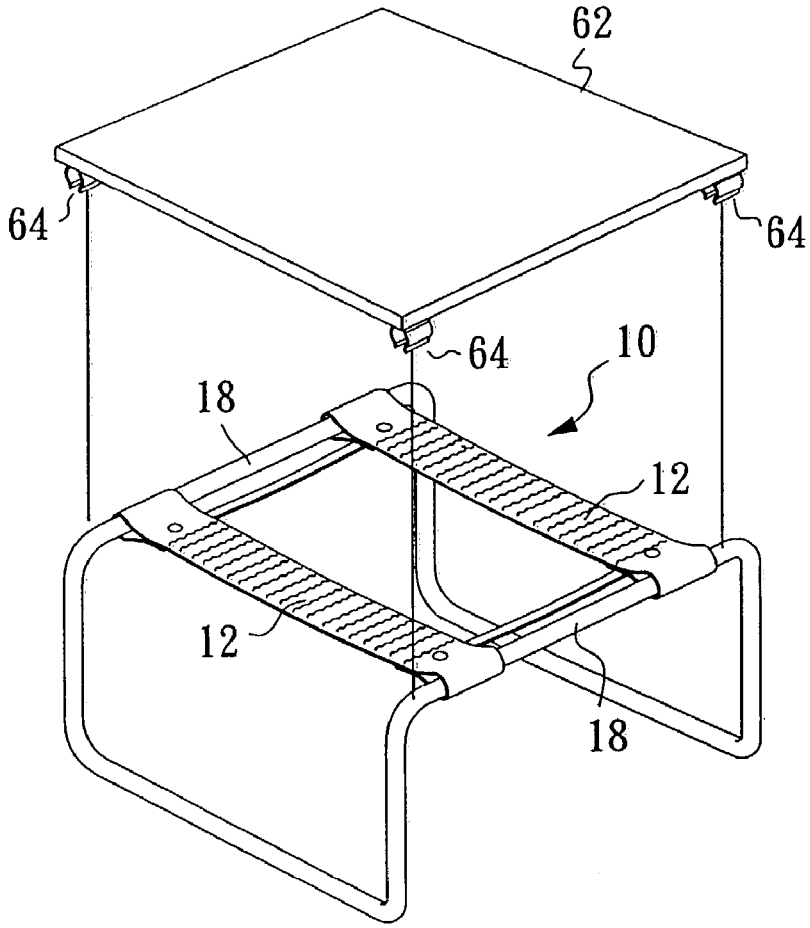
FIG. 11 is a partially exploded perspective view of a sixth embodiment of a sex aid device in accordance with the present invention.
Figure 12:
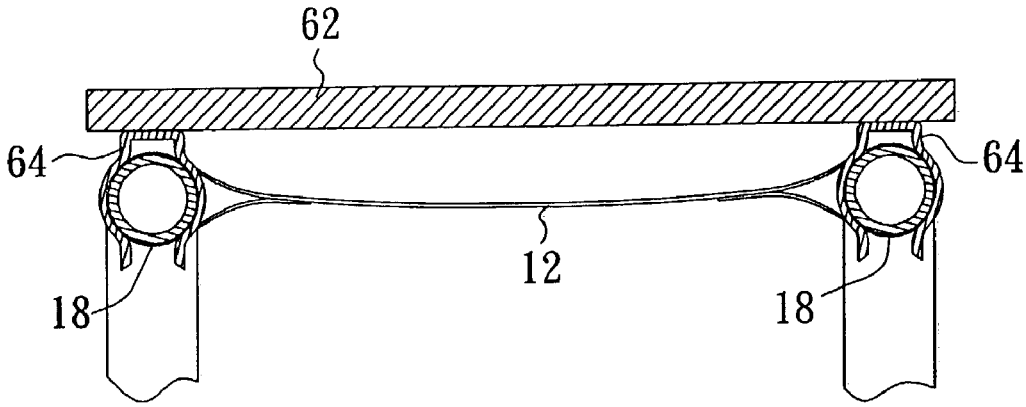
FIG. 12 is a cross-sectional view of the device and plate of FIG. 11 in assembled condition.
Figure 13:
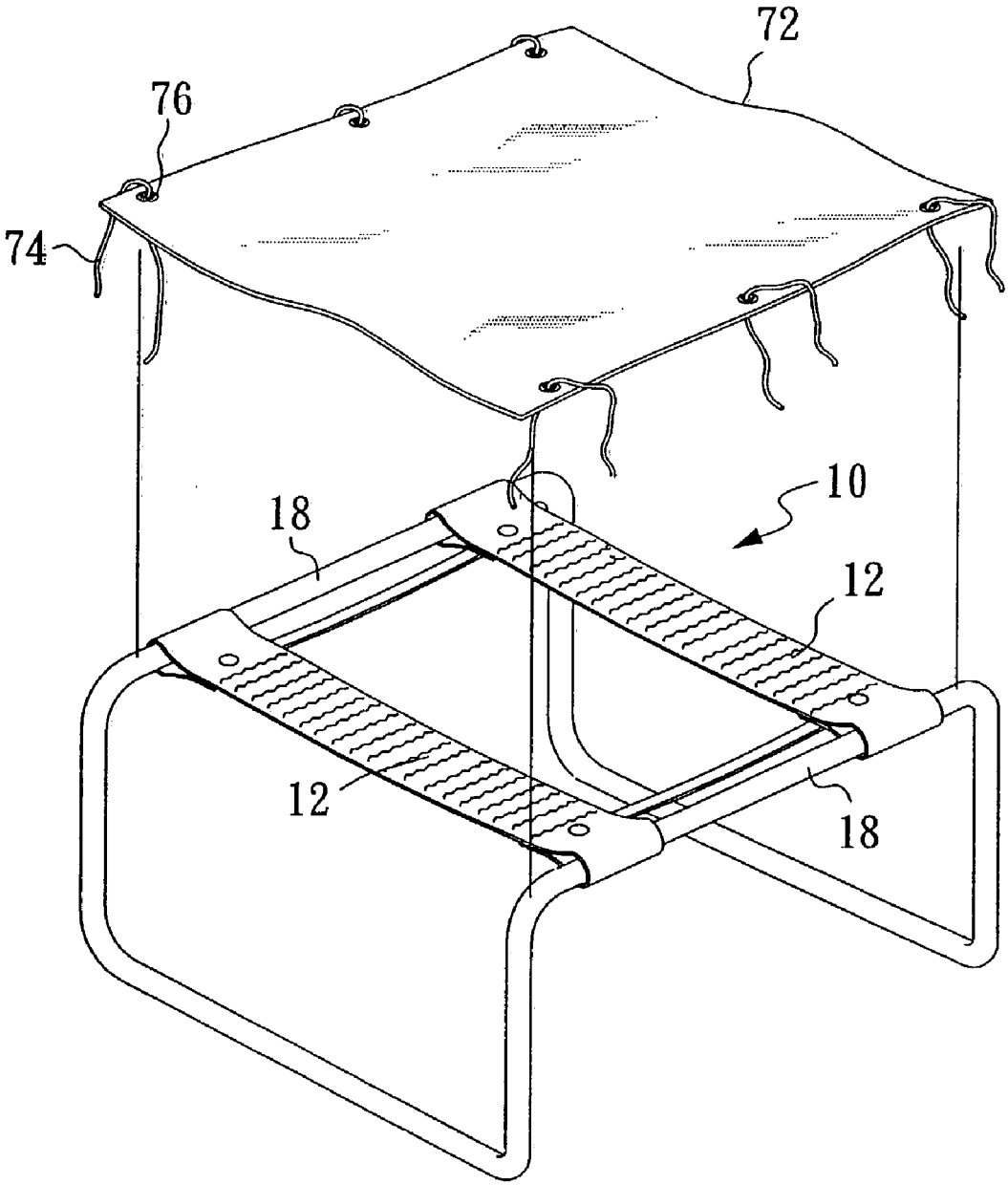
FIG. 13 is a partially exploded perspective view of a seventh embodiment of a sex aid device in accordance with the present invention.

FIGS. 11 and 12 illustrate that a rigid plate 62 may be removably fitted on the rods 18 of the device 10 of FIG. 1 so that the device 10 may serve as a table or chair with the plate 62 overlaying the belts 12. As shown in FIGS. 11 & 12, four snap-in clips 64 are provided on four corners of the bottom side of the plate 62 for clipping on the rods 18. By means of such snap-in clips 64, the plate 62 can be removably mounted on rods 18. Alternatively, a piece of soft, non-resilient rectangular cloth 72 may substitute for the rigid plate 62, as shown in FIG. 13. The cloth 72 is provided with a plurality of ring fastener 76 along two sides parallel to the rods 18 so that the cloth 72 can be attached to the rods 18 by strings 74 passing through the ring fasteners 76 and tied to the rods 18 with the cloth 72 overlaying the belts 12.

While several embodiments of the invention have been shown and described, it will be obvious to those skilled in the art that changes and modifications may be made without departing from the invention in its broader aspects. Accordingly, the present invention is to be limited solely to the scope of the appended claims.

I claim:

1. A sex aid device to assist a human male and female couple to engage in sexual intercourse, particularly for serving those who are handicapped in limbs as a functional aid device, or for serving those who are aged, infirmed or corpulent as a physical strength aid device during sexual activity, said device comprising:

a frame having a leg portion and a support portion disposed exclusively in a direction transverse to a direction of the leg portion at front and rear ends of said frame, said support portion being thereby configured for allowing a male to lie down beneath said support portion without being hindered by said leg portion;

at least one resilient member having front and rear ends and left and right sides, each said at least one resilient member having its front and rear ends attached to said support portion, said right and left sides of said resilient member being unsupported and no parts of said leg portion and support portion being arranged in an area adjacent to said right and left sides such that a female seated on said support portion can move her thighs without obstruction in said area, said at least one resilient member defining at least one opening configured to allow genitals of a female seated on said at least one resilient member to be accessed by genitals of a male lying therebeneath; and whereby a female seated on said at least one resilient member may proceed up-and-down or perform up to 360-degree rotational movement during sexual activity without laterally bumping against said frame while being supported by said at least one resilient member, thereby facilitating control of body action or alleviating burden of physical strength.

2. The device as defined in claim 1, wherein said at least one resilient member comprises a single piece of resilient cloth having a central opening.

3. The device as defined in claim 1, wherein said at lest one resilient member comprises two separated resilient belts defining an opening therebetween.

4. The device as defined in claim 3, further comprising at least one adjustable limiting member connected between said two resilient belts to restrict relative transverse movement of said resilient belts.

5. The device as defined in claim 3, further comprising a plurality of buckles each attached to one end of said resilient belts so that each of said resilient belts can be removably mounted on said support portion.

6. The device as defined in claim 1, wherein said support portion comprises a pair of substantially parallel, transverse rods and said leg portion comprises a pair of substantially U-shaped upright legs, said rods being transversely connected to said legs.

7. The device as defined in claim 1, wherein said leg portion comprises a substantially U-shaped leg disposed substantially parallel to ground, and said support portion comprises a substantially T-shaped rod extending upward from the close end of said U-shaped leg and an inverted U-shaped rod extending upward from the open end of said U-shaped leg.

8. The device as defined in claim 6, further comprising a plurality of couplers for removably connecting said rods with said legs.

9. The device as defined in claim 1, further comprising a rigid plate removably mounted onto said support portion, with said plate overlying said at least one resilient member.

10. The device as defined in claim 1, further comprising a piece of non-resilient cloth removably fastened to said support portion, with said cloth overlying said at least one resilient member.

11. A sex aid device to assist a human male and female couple to engage in sexual intercourse, particularly for serving those who are handicapped in limbs as a functional aid device, or for serving those who are aged, infirm, or corpulent as a physical strength aid device, said device comprising:

a frame including a pair of substantially parallel, transverse rods and a pair of substantially U-shaped upright legs for allowing said male to lie down beneath said rods, said rods being transversely connected to said legs to extend exclusively in a direction transverse to a direction of the legs at front and rear ends of said frame;

a plurality of resilient belts each having front and rear ends and left and right sides, each of said resilient belts having its front and rear ends attached to said rods for providing a seat for said female above said male lying beneath said rods, wherein said left and right sides of said belts are unsupported and no parts of said legs and rods are arranged in an area adjacent said left and right sides such that a female seated on said belts can move her thighs without obstruction within said area, and wherein said resilient belts define at least one opening allowing genitals of said female seated on said resilient belts to be accessed by said male lying therebeneath;

at least one adjustable band attached to said resilient belts to adjustably restrict relative transverse movement between said resilient belts;

a plurality of buckles attached to each end of said resilient belts, allowing each of said resilient belts to be removably mounted on said rods;

whereby said female seated on said resilient belts may proceed up-and-down or 360-degree rotational movement during sexual activity while supported by said resilient belts without laterally bumping into said frame, thereby facilitating control of body action or alleviating burden of physical strength.

12. The device as defined in claim 11, further comprising a rigid plate removably mounted onto said rods, with said plate overlying said resilient belts.

13. The device as defined in claim 11, further comprising a piece of non-resilient cloth removably fastened to said rods, with said cloth overlying said resilient belts.

14. A sex aid device for a human male and female couple to engage in sexual intercourse, particularly for serving those who are handicapped in limbs as a functional aid device, or serving for those who are aged, infirm, or corpulent as a physical strength aid device, said device comprising:

a frame including a pair of substantially parallel, transverse rods, a plurality of couplers, and a pair of substantially U-shaped upright legs for allowing said male to lie down beneath said transverse rods, said plurality of couplers allowing said transverse rods to be removably and transversely connected to said legs to extend exclusively in a direction transverse to a direction of the legs at front and rear ends of said frame;

a plurality of resilient belts each having front and rear ends and left and right sides, each of said resilient belts having its front and rear ends attached to said rods for providing a seat for said female above said male lying beneath said rods, wherein said left and right sides of said belts are unsupported and no parts of said legs and rods are arranged in an area adjacent said left and right sides such that a female seated on said belts can move her thighs without obstruction within said area, and wherein said resilient belts define at least one opening allowing genitals of said female seated on said resilient belts to be accessed by said male lying therebeneath; and at least one adjustable band attached to said resilient belts to adjustably restrict relative transverse movement between said resilient belts, whereby said female seated on said resilient belts may proceed up-and-down or 360-degree rotational movement during sexual activity while supported by said resilient belts and without laterally bumping into said frame, thereby facilitating control of body action or alleviating burden of physical strength.

15. The device as defined in claim 14, further comprising a plate removably mounted onto said rods, with said plate overlying said resilient belts.

16. The device as defined in claim 14, further comprising a piece of non-resilient cloth removably fastened to said rods, with said cloth overlying said resilient belts.

* * * * *